United States Patent [19]

Allan et al.

[11] Patent Number: 4,457,336

[45] Date of Patent: Jul. 3, 1984

[54] AIR FLOW CONTROL APPARATUS

[75] Inventors: Thomas T. Allan, Washington; Cecil W. Bowers, Chocawinity; Joseph A. Wood, Greenville, all of N. Ca.

[73] Assignee: Flanders Filters, Inc., Washington, N.C.

[21] Appl. No.: 398,404

[22] Filed: Jul. 14, 1982

[51] Int. Cl.[3] ..... F16K 1/20; F24F 13/10

[52] U.S. Cl. ..... 137/601; 98/121 A

[58] Field of Search ..... 137/601; 98/121 A

[56] References Cited

U.S. PATENT DOCUMENTS

| | | | |
|---|---|---|---|
| 2,586,997 | 2/1952 | Schach . | |
| 2,890,716 | 6/1959 | Werder | 137/512.15 |
| 2,974,680 | 3/1961 | Kreuttner . | |
| 3,223,113 | 12/1965 | Hopper | 137/601 X |
| 3,426,507 | 2/1969 | Kossowski et al. . | |
| 3,831,350 | 8/1974 | Gilles et al. . | |
| 3,910,782 | 10/1975 | Struble et al. . | |

FOREIGN PATENT DOCUMENTS 868543 10/1957 United Kingdom .

OTHER PUBLICATIONS

Technocheck Dampers and Valves for Nuclear Service, 16 pages, Published by Techno, Erie, Pa. 16505.

Nuclear Air Cleaning Handbook, Burchsted et al., ERDA 76-21, 1976, pp. 116-121.

*Primary Examiner*—Martin P. Schwadron

*Assistant Examiner*—Stephen M. Hepperle

*Attorney, Agent, or Firm*—Bell, Seltzer, Park & Gibson

[57] ABSTRACT

An air flow control apparatus is disclosed which is characterized by an essentially zero leakage rate in its closed position, and by minimal air resistance in its open position. The apparatus includes an orifice panel which defines a plurality of troughs of V-shaped cross section, with at least one elongate opening disposed in each trough. A closure is associated with each trough, and includes a pair of pivotally mounted plates which are movable between a spread apart position wherein the plates cover and close the openings in the trough, and a collapsed position wherein the plates are contiguous to each other and spaced from the associated openings to permit free air flow therethrough. A hinge pivotally interconnects the free edges of each pair of plates, and control means is provided for effecting operation of the closures. In one embodiment, the apparatus comprises a damper assembly composed of the orifice panel and closures, and which is removably mounted in a duct so as to facilitate its repair and replacement. In such embodiment the control means includes a plurality of generally circular cams mounted on a pair of rotatable shafts in the duct for operatively engaging the hinges of the closures, to thereby selectively spread apart the pairs of plates. In another embodiment, the apparatus is designed to be permanently mounted in a duct, and the control means for actuating the closure plates includes linkages which are connected to rotatable shafts.

14 Claims, 28 Drawing Figures

AIR FLOW CONTROL APPARATUS

The present invention relates to a novel air flow control apparatus of the type having the ability to function in a variety of ventilation systems as a shutoff damper, or as a flow control damper for modulating the air flow rate or a pressure differential within the system.

At the present time, there are a number of different damper configurations for regulating the air flow within a ventilation system. For example, one present damper comprises multiple blades which rotate in either the same or opposite directions to effect air flow control. Another common damper comprises one centrally pivoted blade mounted within the duct. Still another known design involves a damper with two blades which are pivoted from opposite sides of a central post in the duct.

While the above known dampers are satisfactory in many air ventilation systems, they are difficult to effectively seal in the closed position, and they have an unacceptable leakage rate in many air ventilation systems. For example, in the case of an exhaust air cleaning system of the type designed for the containment of hazardous materials, such as an airstream containing potentially radioactive materials, or in other high risk applications, it is conventional to use ball-type shut-off valves of a type which are primarily designed for liquid service. However, these valves are very expensive, they require round rather than conventionally used rectangular air ducting, and they present a high resistance to the air flow in their open position and thus they result in a high pressure drop across the valve.

A further disadvantage of present damper configurations relates to the fact that they are often located in inaccessible locations, and they are difficult to reach and repair in the event of a malfunction, without disassembly of a large portion of the duct.

It is accordingly an object of the present invention to provide a relatively inexpensive air flow control damper of the described type, and which may be used in air cleaning systems designed for the containment of nuclear or other hazardous materials, as well as in a variety of other more conventional air ventilation systems.

It is a more particular object of the present invention to provide an air flow control damper which is characterized by an essentially zero leakage rate in the closed position, and by minimal air resistance in the open position so as to minimize the pressure drop across the damper.

It is also an object of the present invention to provide an air flow control damper which may be constructed so as to be readily removable from the air duct to facilitate its repair or replacement.

These and other objects and advantages of the present invention are achieved in the embodiment illustrated herein by the provision of a damper which includes an orifice panel extending transversely across the duct and including at least one trough of V-shaped cross section, with each trough having at least one elongate opening extending therethrough. A closure is operatively associated with each of the troughs for selectively opening and closing each of the openings therein, and each closure is sized to overlie and cover the peripheral edge portion of each opening. Also, the closure is mounted for movement between closed and open positions, and such that the opposed portions of the closure and peripheral edge portion are relatively movable in a generally perpendicular direction toward and away from each other. Resilient sealing means is preferably positioned to surround the opening and be compressed to effect sealing of the opening when the closure is in its closed position. Further, control means are provided for effecting selective movement of each of the closures between its open and closed positions, to permit full opening or full closure of the damper as well as modulation of the air flow rate.

In one preferred embodiment as specifically illustrated herein, the orifice panel includes a plurality of troughs of V-shape in cross section, with the openings being disposed in each of the side walls of the troughs. Also, the closure for each trough is in the form of a pair of flat plates which are pivotally mounted for movement along an axis extending longitudinally along the trough and adjacent the bight thereof. The free edges of the plates are interconnected by a hinge, and such that pivotal movement of the hinge about its axis acts to either spread apart of collapse the pair of plates. Further, the orifice panel is mounted on a rectangular frame, which may be admitted into and withdrawn from the air duct through a side access door which is provided therein, and means are provided for releasably sealing the frame in its operative position within the housing. The control means for effecting pivotal movement of the plates includes cam means mounted within the duct and operable from outside the duct for engaging the hinge of each closure.

Some of the objects having been stated, other objects will appear as the description proceeds, when taken in connection with the accompanying drawings in which FIG. 1 is a perspective view of a housing for a high efficiency particulate air filter, and which includes a pair of air flow control dampers in accordance with one embodiment of the invention;

Figure 1:
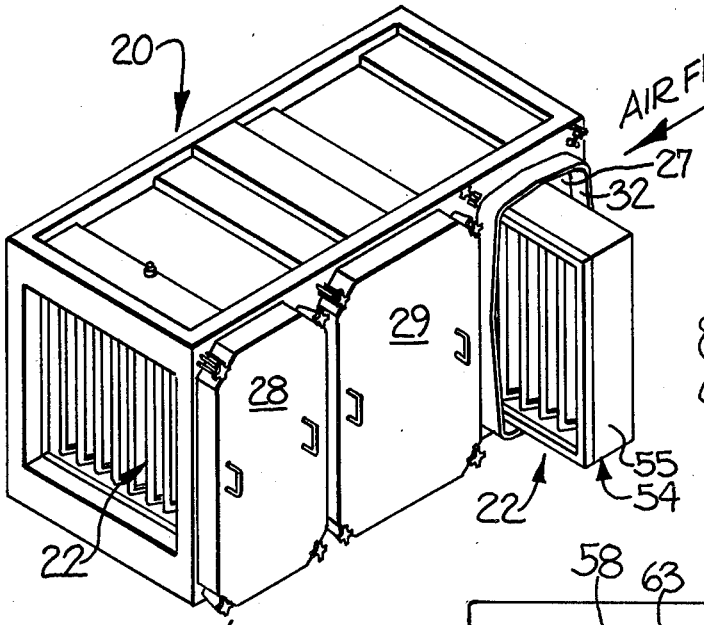

Referring more particularly to the drawings, FIGS. 1–4 illustrate a housing 20 for a high efficiency air filter 21, and which includes a pair of dampers 22 in accordance with a preferred embodiment of the invention. The housing 20 is adapted to be utilized, for example, in an air ventilating or air cleaning system of the type illustrated in FIG. 26 and as further described below. The housing defines a generally rectangular air passageway therethrough, and includes three side access openings 25, 26, 27 and removable doors 28, 29, 30 for admitting or removing components as hereinafter further described. Each of the openings 25, 26, 27 includes a grooved peripheral ring 32 for attachment of a plastic bag (not shown) for containing the removed component in accordance with the standard and well known bag-in and bag-out procedure.

Figure 11:
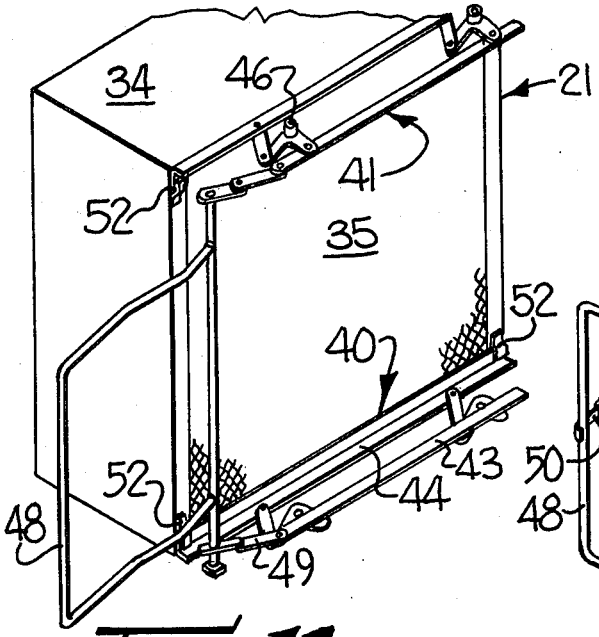
FIG. 11 is a fragmentary perspective view illustrating the upper and lower clamping members for seating and unseating a filter or damper assembly in the housing.

A HEPA filter 21 of conventional design is adapted to be mounted at a central location in the housing. As best seen in FIG. 11, the filter includes a four-sided wood, metal, or molded plastic frame 34, and which supports a folded pack of filtering media 35. The frame of the filter typically measures $24\times24\times11\frac{1}{2}$ inches, and includes a fluid filled channel 36 about its front periphery for sealably engaging a mating rectangular retainer 38 which is fixedly mounted in the interior of the housing in the manner further described in U.S. patents to Allan et al, U.S. Pat. Nos. RE 27,701; 4,082,525; and 4,233,044.

In order to seat and unseat the filter 21 against its sealing retainer 38, there is provided a pair of filter clamping mechanisms 40, 41 extending respectively along the upper and lower housing walls (note FIG. 11). Each mechanism 40, 41 comprises a pair of parallel elongate angle bars 43, 44 which are interconnected by a number of pivotal linkages 45 which are pivotable about the post 46. A locking handle 48 is pivotally mounted at the door opening of the housing for rotation about a vertical axis, and a linkage 49 interconnects the pivot rod of the handle to the angle bar 43 of each mechanism, and such that rotation of the handle 48 results in the bars 43 moving essentially laterally (i.e., parallel to the face of the filter) and the bars 44 moving longitudinally toward or away from the filter. A latch 50 is also mounted at the door opening for engaging the handle when the bars are moved to their separated or locked position. The rear side of the filter 21 incorporates a pair of clips 52 for slideably receiving the angle bar 44, and such that movement of the bar 44 acts to correspondingly move the filter.

Figure 4:
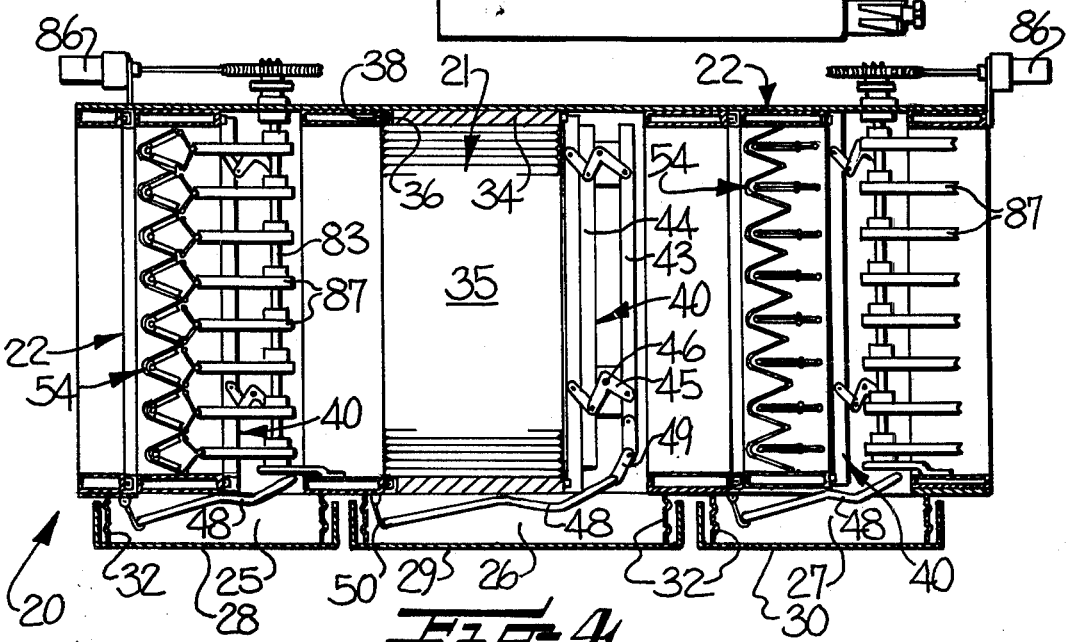
FIG. 4 is a sectional top plan view of the housing shown in FIG. 1.

To initially place the filter 21 in the housing 20, the door 29 is removed, and the handle 48 is rotated counterclockwise as seen in FIG. 4 to move the angle bar 44 toward the right. The filter 21 may then be slid laterally into the housing, with the clips 52 sliding along the bar 44. Upon the filter being fully inserted, the handle 48 is rotated clockwise, causing the bar 44 to move to the left and thereby seat the filter against its sealing retainer 38. The handle 48 is then locked in the seated position by engagement with the latch 50. As will be understood, this procedure may be accomplished while working through a bag mounted on the ring 32 of the door opening 26 in accordance with the standard bag-in procedure. To subsequently remove the filter, the process is reversed to first unseat the filter to a position where it may be laterally withdrawn through the opening 26 and into a receiving bag.

Figure 12:
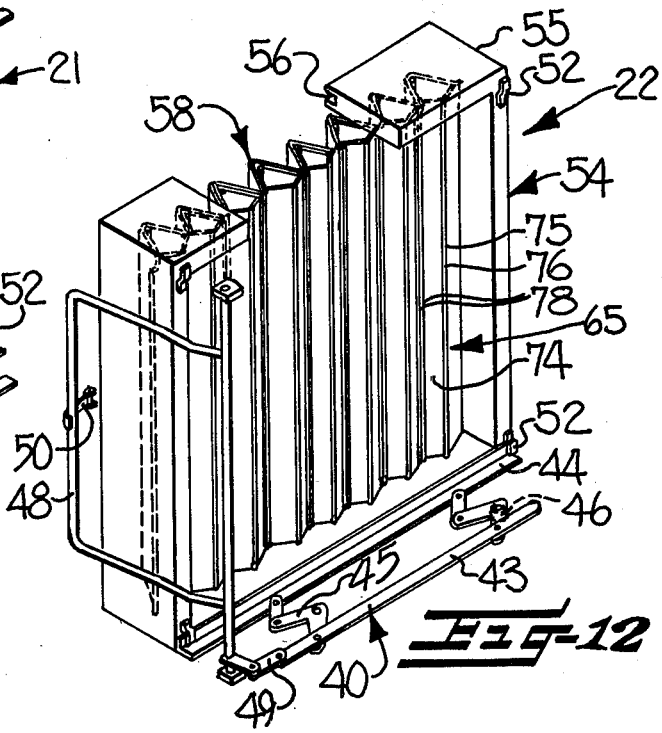
FIG. 12 is a view similar to FIG. 11, but illustrating the clamping member for a damper assembly.
Figure 13:
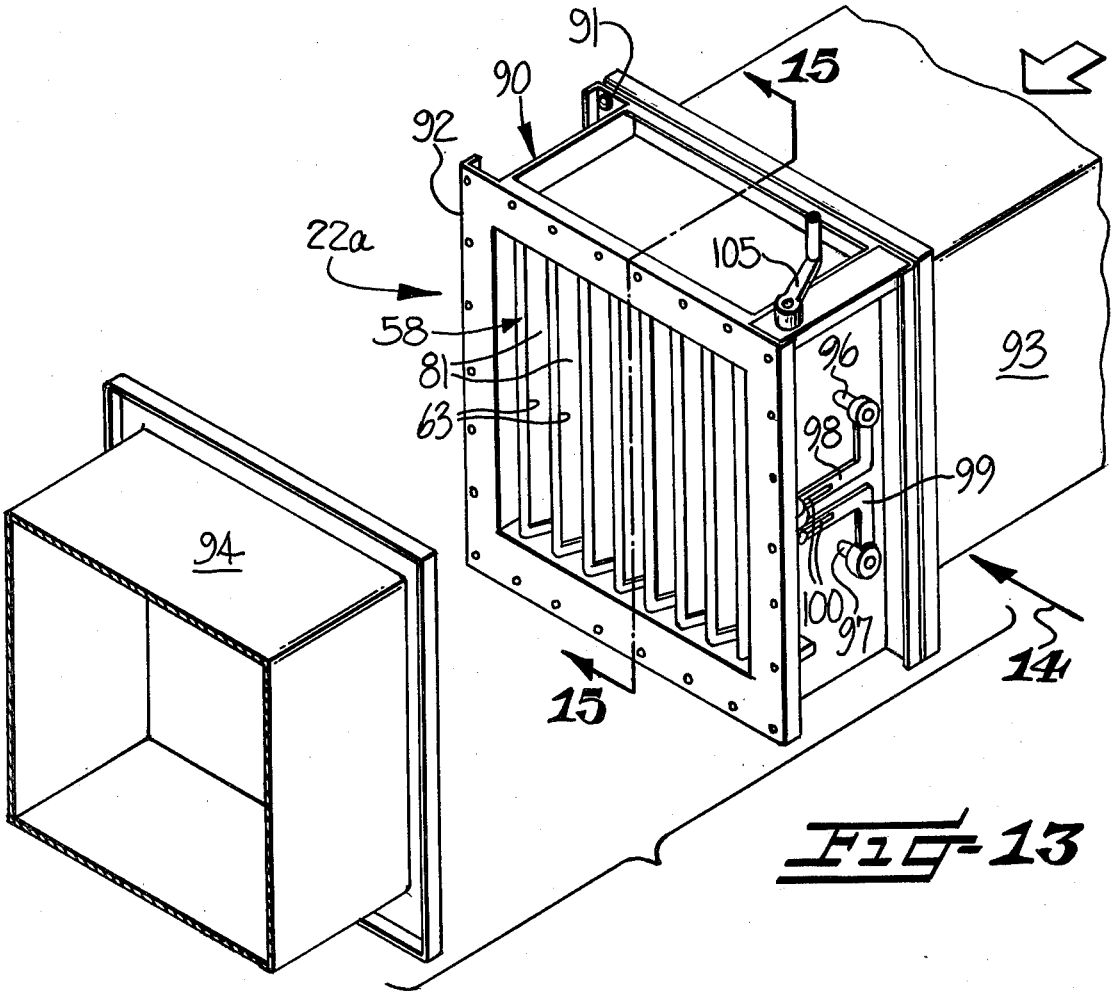
FIG. 13 is an exploded perspective view of another embodiment of the air flow control apparatus of the present invention.
Figure 14:
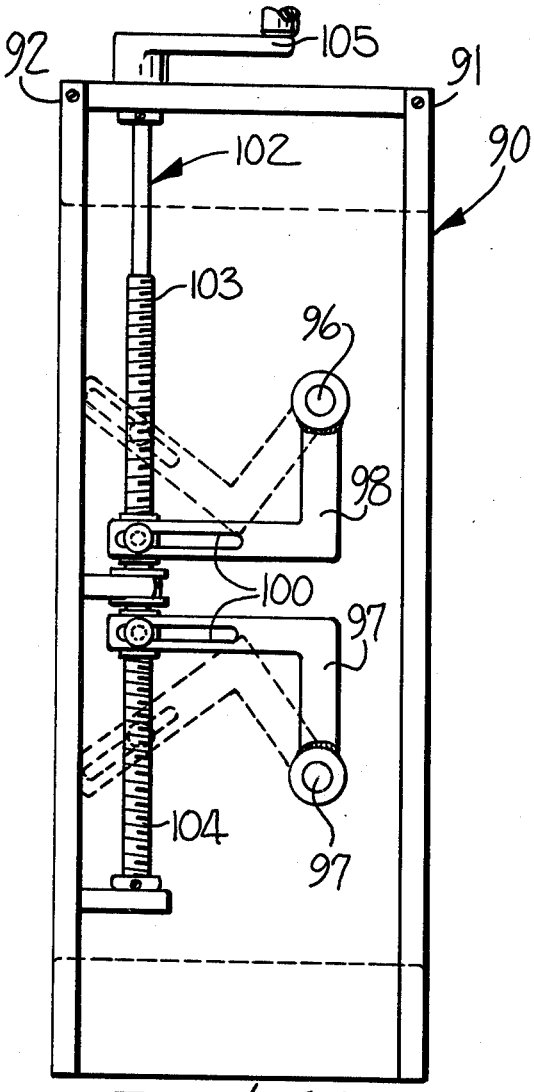
FIG. 14 is a side elevation view of the apparatus taken in the direction of arrow 14 in FIG. 13.

A damper 22 which embodies the present invention is mounted within the housing on each side of the filter 21. Each damper 22 includes a damper assembly 54 as best seen in FIGS. 1 and 12, which comprises a rectangular peripheral frame 55 which typically measures about 24 by 24 by 6 inches, and so as to closely conform to the size of the interior of the housing. The frame 55 is preferably fabricated from a suitable metallic material, and mounts a fluid-filled channel 56 about the front periphery for sealably engaging a retainer 57 fixed in the housing in a manner similar to that described above with respect to the filter 21.

The damper assembly 54 also includes an orifice panel 58 extending transversely across the frame 55 to fill the area defined thereby. The orifice panel 58, which is preferably formed of a relatively heavy sheet metal material, is formed into a plurality of troughs 59 of V-shaped cross section, with the troughs being disposed in a side by side parallel arrangement, and with each trough extending substantially the full distance between two opposite sides of the frame 55. Also, each trough 59 includes two generally flat side walls 60, 61, with each side wall 60, 61 having an elongate rectangular opening 62, 63 disposed therein which extends along essentially the full length of the trough.

Figure 5:
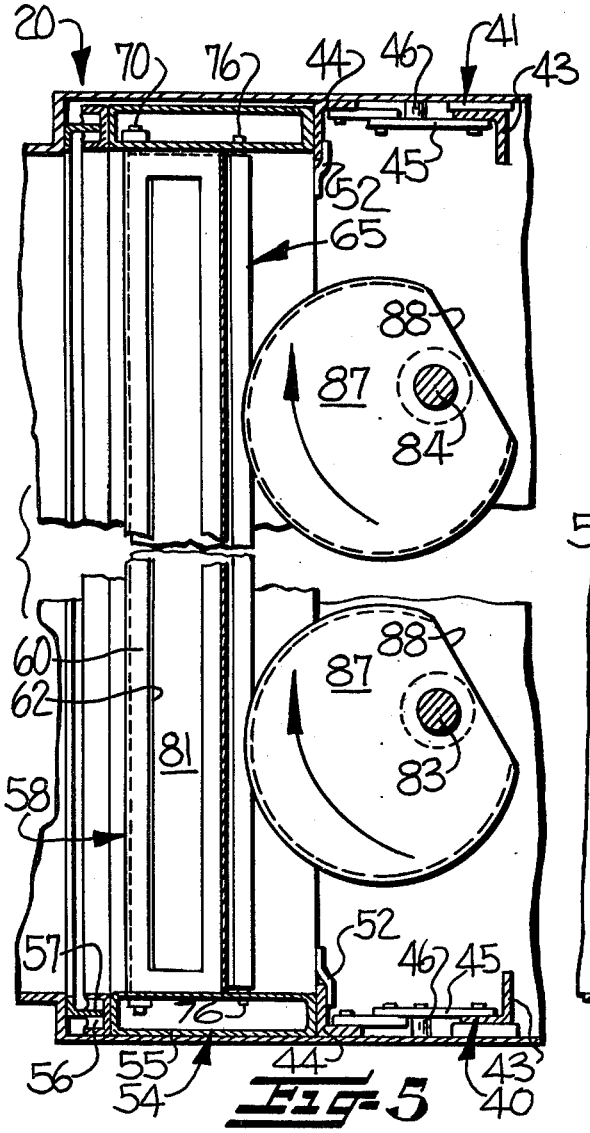
FIG. 5 is a fragmentary sectional side elevation view illustrating one of the damper assemblies in its closed position.
Figure 6:
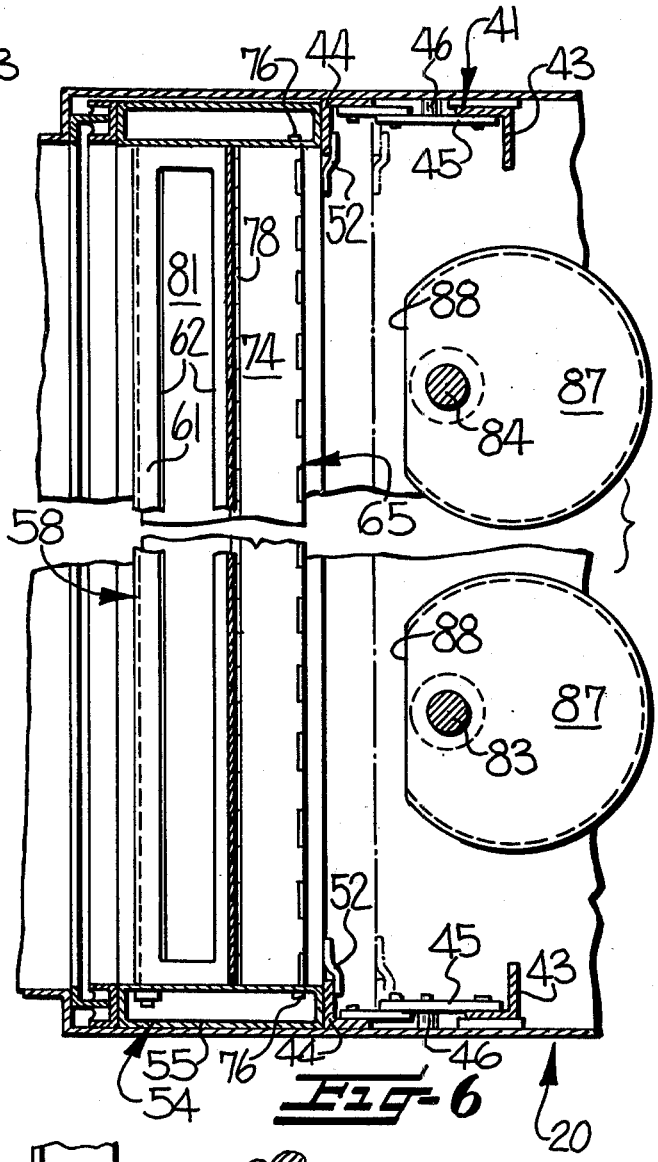
FIG. 6 is a view similar to FIG. 5 and illustrating the damper assembly in its open position, and wherein the damper assembly may be laterally withdrawn from its sealing position so as to permit its lateral removal through an opening in the side of the housing.
Figure 7:
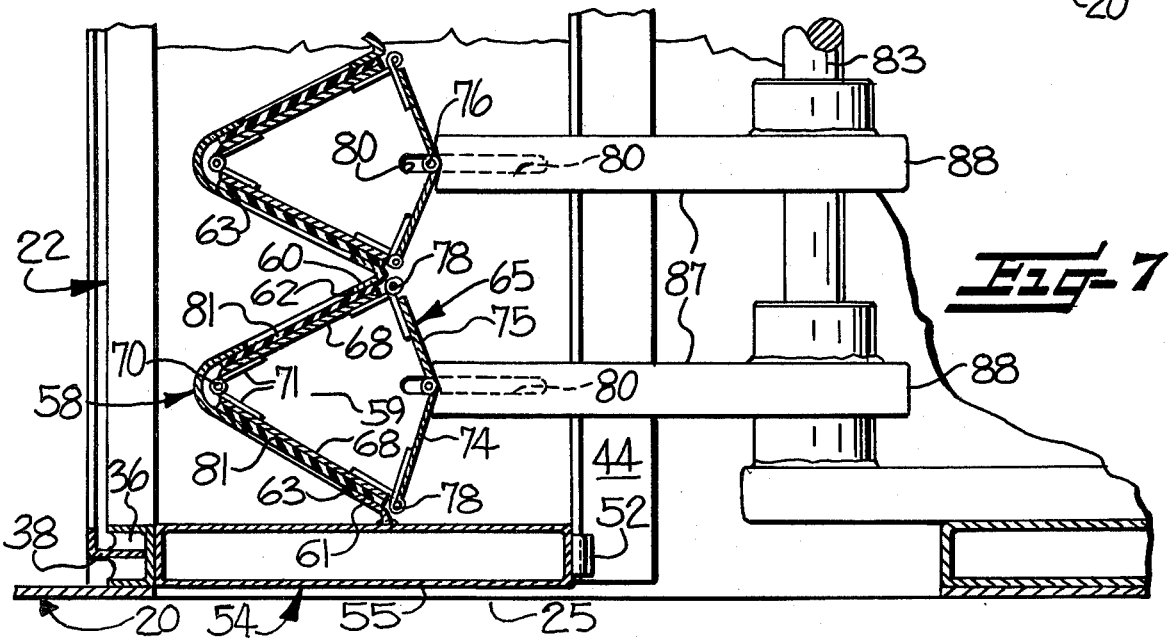
FIG. 7 is a fragmentary sectional top plan view showing the damper assembly in its closed position and as seen in FIG. 5.
Figure 8:
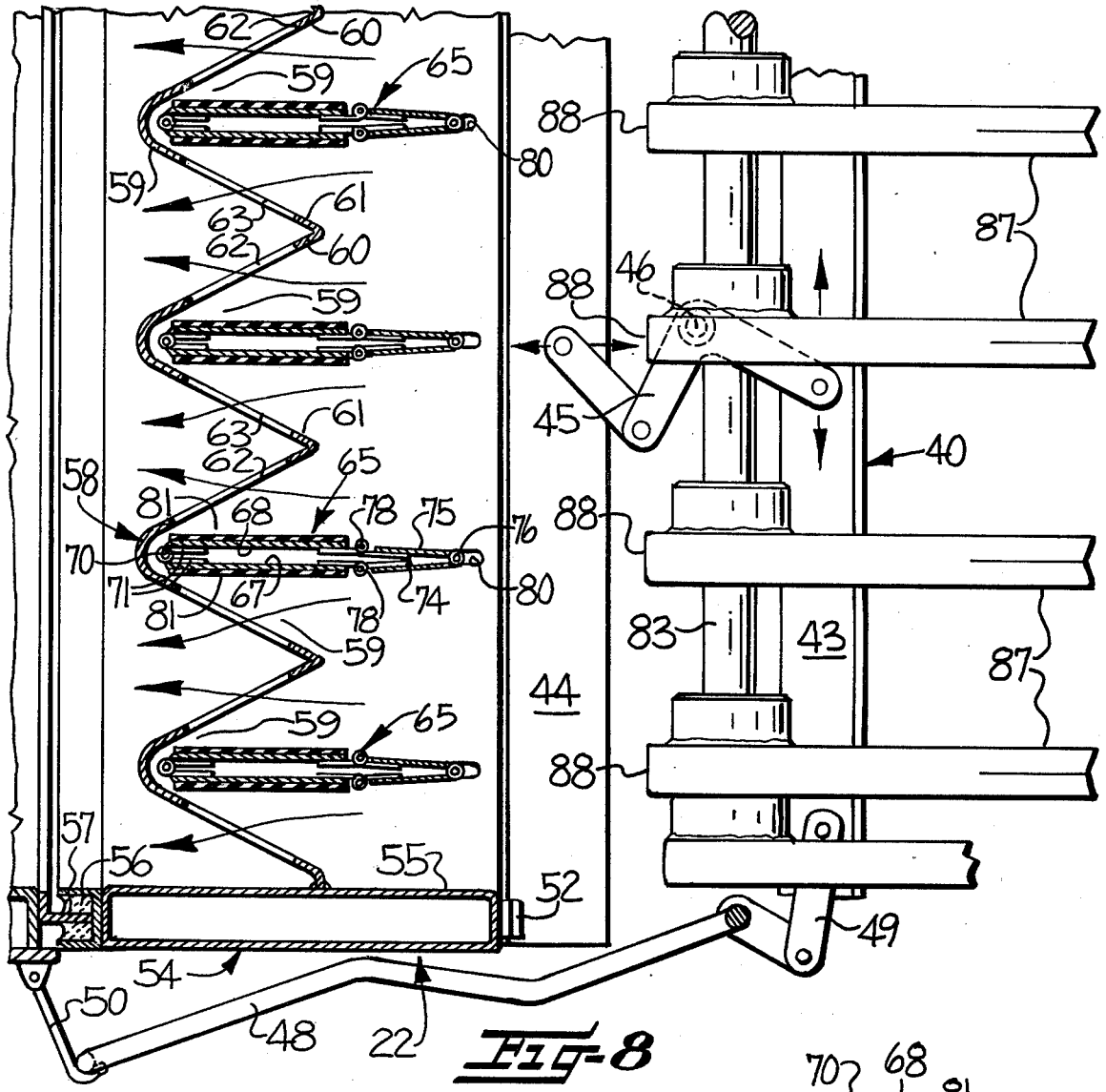
FIG. 8 is a view similar to FIG. 7, but showing the damper assembly in the open position and as seen in FIG. 6.
Figure 9:
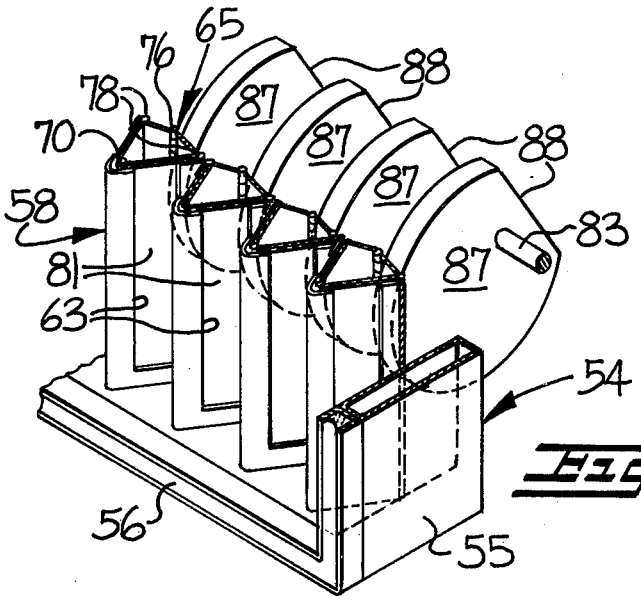
FIG. 9 is a fragmentary perspective view illustrating the damper assembly in the closed position.
Figure 10:
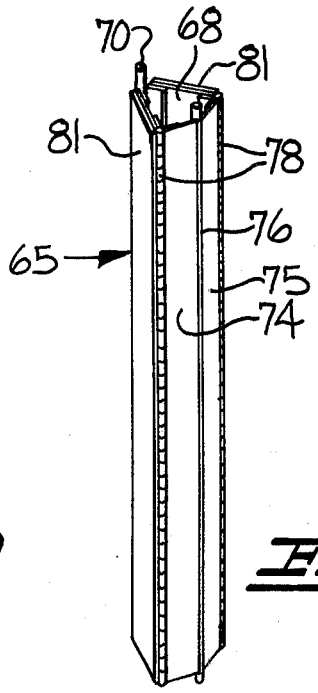
FIG. 10 is a perspective view of one of the closures of the damper assembly of the present invention.

A plurality of closures 65 are mounted on the frame, with one closure operatively associated with each trough 59 for selectively opening and closing the openings 62, 63 in the two associated side walls. Each of the closures 65 includes a pair of flat plates 67, 68 which are pivotally mounted for movement about a pin 70 which extends longitudinally along the trough and adjacent the bight thereof. Each closure 65 further includes a spring biasing member 71 interconnected between the plates for biasing the plates toward each other, and a hinge 72 composed of two segments 74, 75 which are pivotally interconnected by a hinge pin 76. The segments are in turn pivotally connected to respective ones of the free edges of the pair of plates by means of the edge pins 78. The axis of the hinge pin 76, and the pivotal axes of the edge pins 78 are parallel to each other, and to the axis defined by the pin 70. Thus movement of the hinge 72 about its pivotal axis acts to either spread apart or collapse the pair of plates 67, 68. Also, it will be seen that the hinge pin 76 is free to move laterally in the guide slots 80 in the frame, note FIG. 7. In the spread apart position (note FIGS. 5 and 7), each plate 67, 68 covers and closes the opening 62, 63 in the adjacent trough side wall, and in the collapsed position (note FIGS. 6 and 8) the plates are contiguous to each other and spaced from the associated openings to open the same. Each of the plates 67, 68 includes a resilient elastomeric sheet 81 adhered to the outer surface thereof, with each sheet 81 being sized to surround the associated opening and be compressed to effect sealing of the opening when the plates are in its closed position. More particularly, the plates 67, 68 will be seen to move in a direction generally perpendicular to the surface of the associated trough side wall, to firmly compress each sheet 81 between the plate and the peripheral edge portion of the opening.

The two damper assemblies 54 are removably mounted within the housing by an arrangement which is generally similar to that described above with respect to the filter 21. More particularly, each damper assembly may be inserted into the housing through an associated door opening 25 or 27, and a pair of cooperating clamping mechanisms 40, 41 as seen in FIGS. 11 and 12 are provided for selectively seating and unseating the assembly against its seal.

Figure 2:
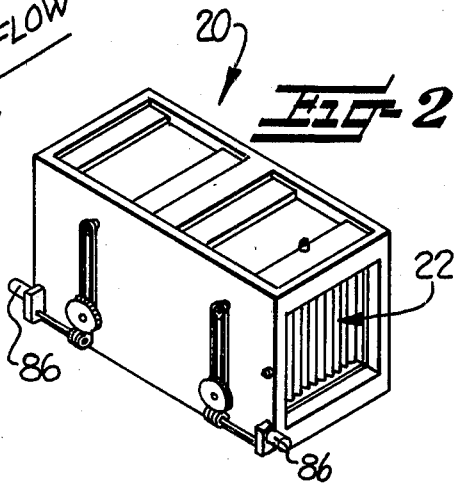
FIG. 2 is a perspective view in reduced scale of the opposite side of the housing shown in FIG. 1.
Figure 3:
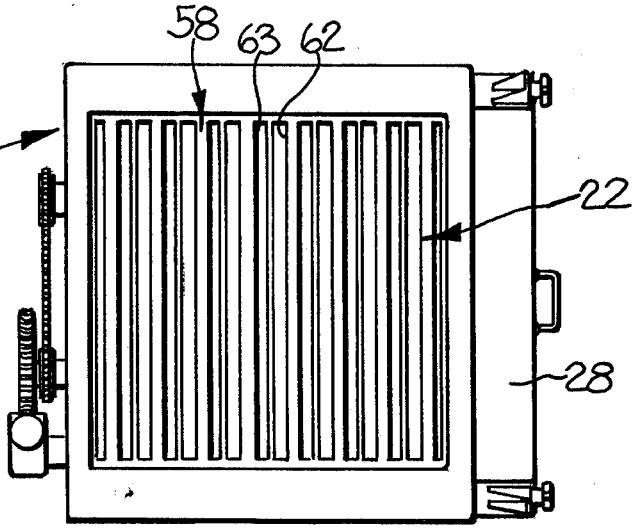
FIG. 3 is a front elevational view of the housing shown in FIG. 1.

Each damper 22 further includes control means operable from without the housing for actuating the closures 65 when the damper assembly is sealably mounted in the housing, and so as to selectively either shut off, fully open, or modulate the air flow through the damper. This control means includes means for engaging each of the hinges 72 adjacent the hinge pin 76 to spread apart the hinges, and thus each of the pair of plates, against the force provided by the spring biasing members 71. As illustrated, this control means includes a pair of vertically spaced apart parallel shafts 83, 84 which are rotatably mounted to extend across the interior of the housing in a direction which is perpendicular to the lengthwise direction of the troughs 59 and adjacent the rear side of the damper assembly, i.e., the side which includes the closures 65. The shafts 83, 84 are rotatably interconnected to rotate in unison, and rotation is effected by a motorized control 86 positioned exteriorly of the housing and as schematically indicated in FIG. 2. Each shaft 83, 84 fixedly mounts a number of cams 87 of like outline, and with each cam being laterally aligned with a corresponding closure 65. The outlines of the cams 87 are generally circular and eccentric to the axis of its shaft. Further, the outline includes a chord segment 88 which, in the position of FIG. 6, permits the damper assembly to be initially inserted into the housing or unseated from its seal.

As will be apparent from FIGS. 5–8, rotation of the two shafts 83, 84 in the clockwise direction results in the cams 87 engaging respective closures 65 adjacent the hinge pin 76, to expand the hinge. The plates 67, 68 are thereby also expanded into sealing engagement with the side walls of the troughs, and thereby sealably close the openings. As will be apparent, the disclosed mechanism is able to press the plates 67, 68 against the side walls 60, 61 with a substantial force, to provide a firm engagement and an essentially zero leakage seal under normal operating conditions.

FIGS. 13–16 illustrate another preferred embodiment of an air flow control apparatus in accordance with the present invention, and which is generally designated **22*a*. In these figures, like numerals are utilized to refer to components which are common to those of the previously described embodiment. The apparatus 22*a* is intended to be permanently mounted in a rectuangular air duct, and it includes a frame 90 having peripheral flanges 91, 92 on the ends for mating with the adjacent duct sections 93, 94**.

The control means for actuating the closures 65 of the apparatus **22*a* includes a pair of vertically spaced apart parallel shafts 96, 97 which are rotatably mounted to extend across the interior of the frame 90 in a direction which is perpendicular to the lengthwise direction of the troughs 59 and adjacent the closures 65. The shafts 96, 97 extend through the side of the frame, and are rotatably interconnected to rotate in opposite directions by means of the associated L-shaped arms 98, 99 which are disposed in opposite orientations on the outer ends of the shafts. Each arm 98, 99 includes a slot 100 adjacent its free end, for the purposes set forth below. A vertically mounted stud 102, having oppositely threaded portions 103, 104, is rotatably mounted on the outside of the frame, and is connected to a hand crank 105. The threaded portions mount nuts 106, 107, respectively, which are slideably connected in the slots 100 of respective arms 98, 99**.

Figure 15:
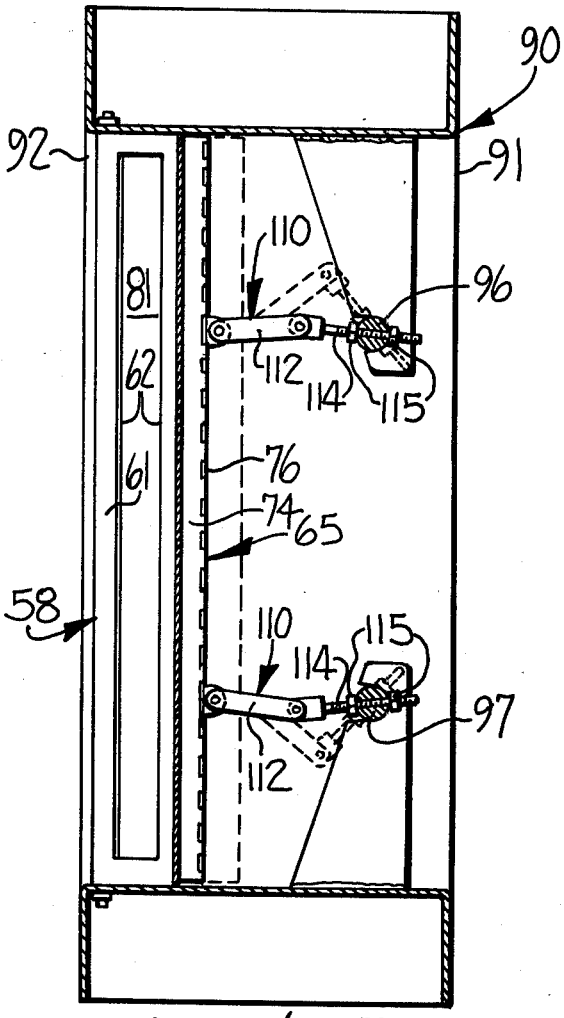
FIG. 15 is a sectional elevation view taken substantially along the line 15—15 of FIG. 13.
Figure 16:
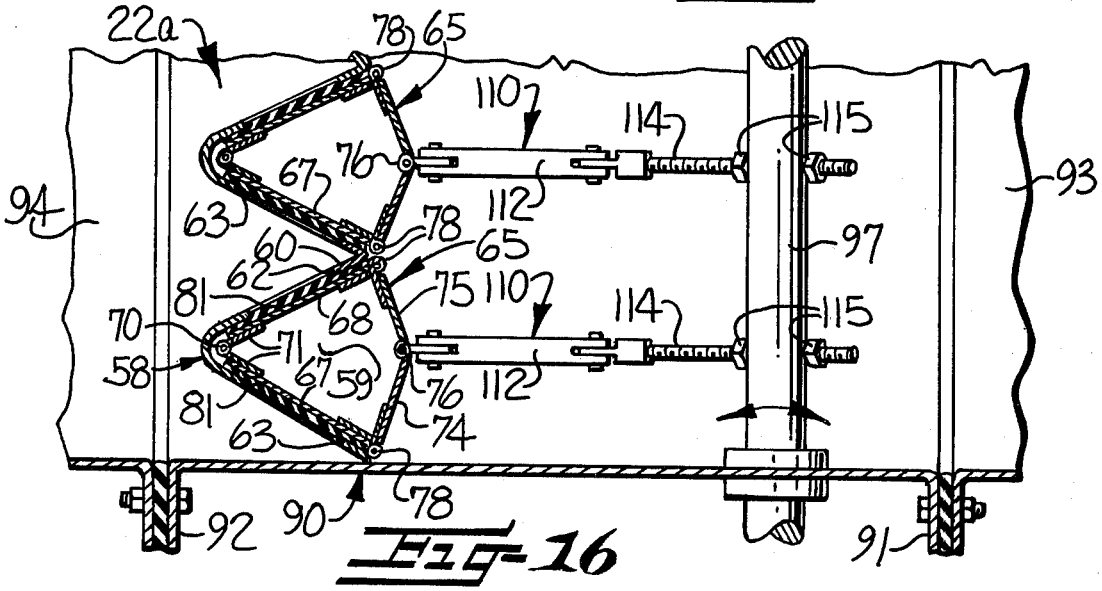
FIG. 16 is a fragmentary sectional plan view of the apparatus shown in FIG. 13.

The control means further includes a pair of linkages 110 operatively associated with each closure 65. As best seen in FIGS. 15 and 16, each linkage 110 is composed of two pivotally interconnected components, with one component 112 being pivotally connected to the hinge 75 adjacent the hinge pin 76, and with the other component 114 comprising a threaded post which extends through an aperture in the associated shaft. A nut 115 is positioned on the threaded post 114 on each side of the shaft to permit adjustment of the effective length of the linkage, and thus the tightness of the seal of the closure.

In operation, rotation of the hand crank 105 causes the arms 98, 99 and thus the shafts 96, 97 to rotate in opposite directions, so as to cause the linkages 110 to move the closures 65 between a closed position as seen in solid lines in FIG. 15, and an open position as seen in dashed lines. Thus the operation of the crank acts to positively actuate the closures in each direction of movement.

Figure 17:
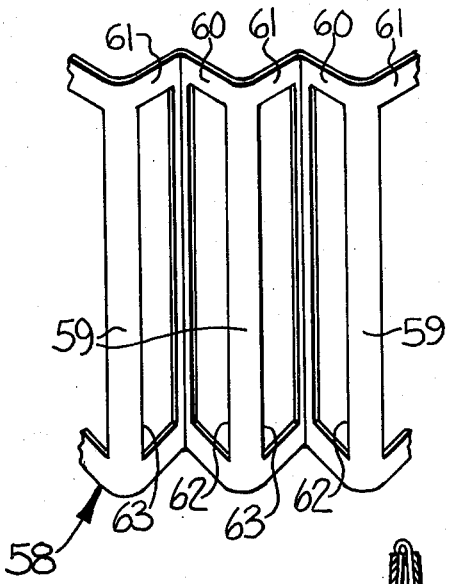
FIG. 17 is a fragmentary perspective view of one embodiment of an orifice panel for use with the present invention.
Figure 18:
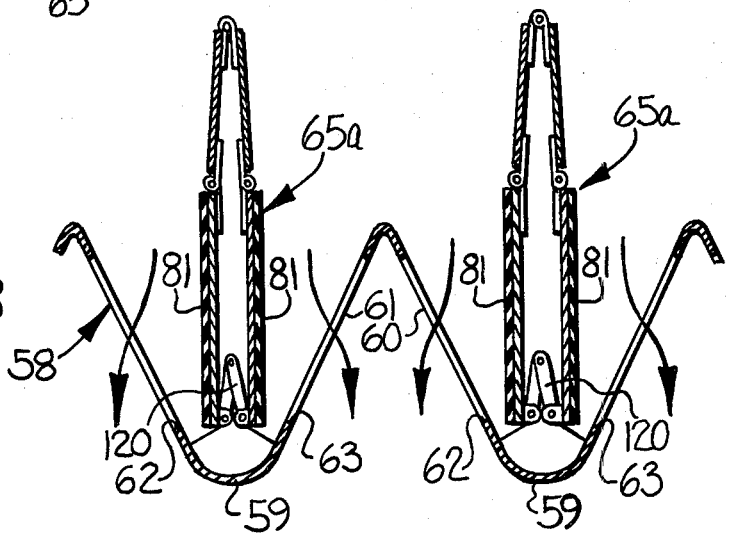
FIG. 18 is a fragmentary sectional plan view illustrating the orifice plate of FIG. 17 and a further embodiment of the closures, shown in the open position.
Figure 19:
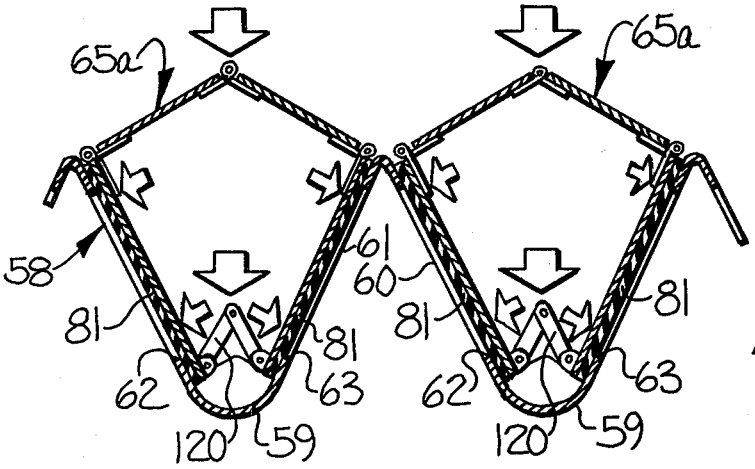
FIG. 19 is a view similar to FIG. 18 but showing the closures in the closed position.

FIGS. 17–19 somewhat schematically illustrate a further embodiment of a closure adapted for use with the present invention, which is indicated by the numeral **65*a*. The closure 65*a* differs from the above described closure 65 in that the forward edges of the plates 67, 68 are interconnected by a second hinge 120. The second hinge 120 is adapted to be operatively connected to a linkage (not shown) which is similar to the linkage 110 described above, for causing the forward edges of the plates to be moved toward and away from the peripheral edge portion of the openings in the manner schematically illustrated by the arrows, to firmly compress the elastomeric sheets 81** and thereby provide a secure seal in the closed position.

Figure 20:
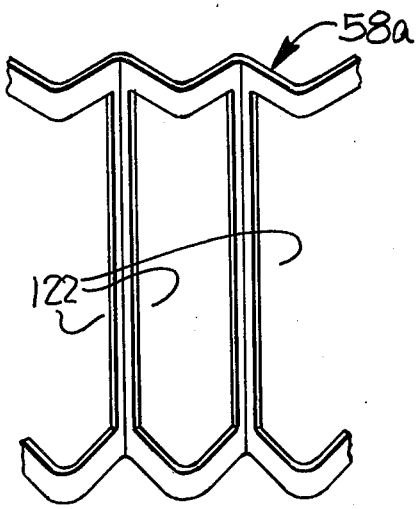
FIG. 20 is a fragmentary perspective view of another embodiment of an orifice panel adapted for use with the present invention.
Figure 21:
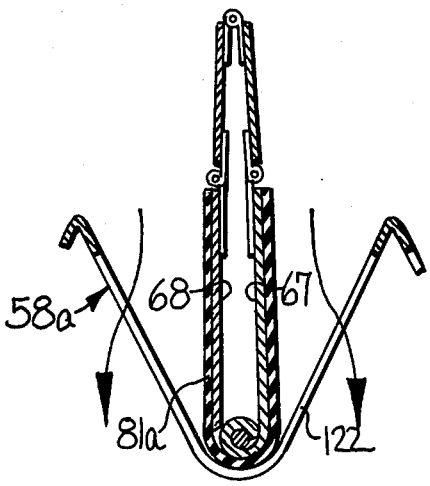
FIGS. 21 and 22 are fragmentary sectional plan views illustrating a further embodiment of the closures, shown in the open and closed positions respectively.
Figure 22:
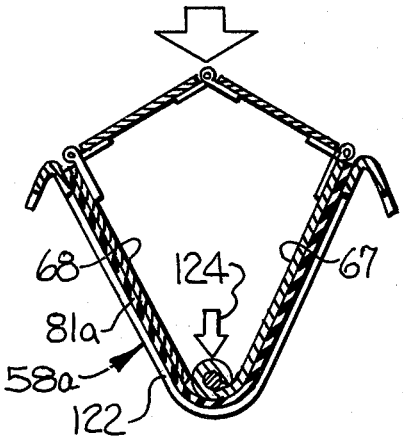

FIGS. 20–22 illustrate a further embodiment wherein the orifice panel 58*a* includes a single elongate opening 122 in each trough, with the opening 122, in cross section, including a substantial portion of each of the side walls and extending across the bight portion. Also a single elastomeric sheet 81*a* is provided, which overlies each of the plates 67, 68 and extends across the bight portion. In this embodiment, it is also preferred that the pivot pin 70 be biased in the direction of the arrow 124 by a suitable linkage (not shown), so that in the closed position a firm sealing engagement is provided between the sheet 81*a* and the entire peripheral edge portion of the opening 122.

Figure 23:
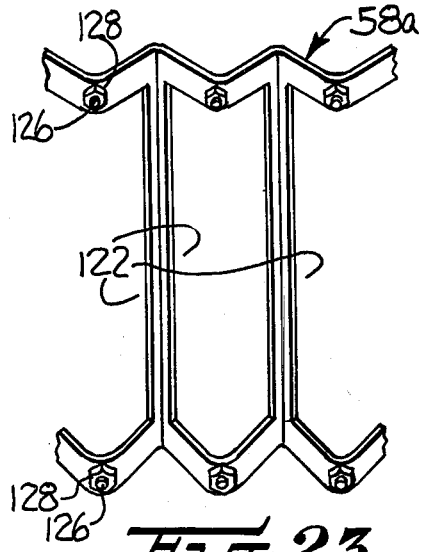
FIGS. 23–25 are views similar to FIGS. 20–22 respectively, and illustrating still another embodiment of the closures.
Figure 24:
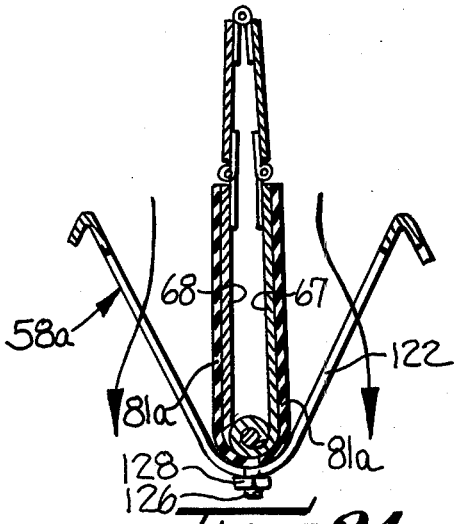
Figure 25:
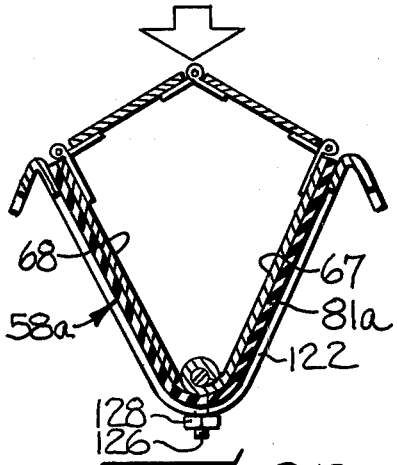

The embodiment illustrated in FIGS. 23–25 differs from that of FIGS. 20–22 only in the specific means for biasing the pin 70 toward the bight of the trough. In the embodiment of FIGS. 23–25, a threaded post 126 extends from the pin 70 and through an aperture in the sheet 81*a* and panel 58*a*, at each end of the opening. Nuts 128 are employed to draw the posts and thus the pins into the bight, to thereby effect a permanent sealing compression of the sheet 81*a* along the bight portion.

Figure 26:
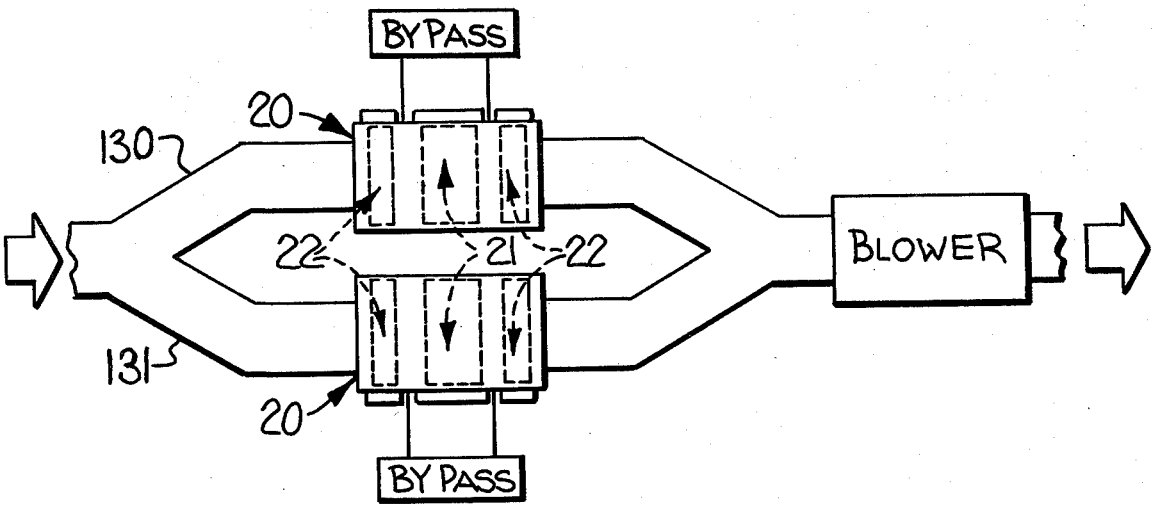
FIG. 26 is a schematic representation of a redundant air cleaning system of the type commonly utilized in the nuclear industry for the containment of potentially hazardous materials, and which is adapted to utilize dampers in accordance with the present invention.
Figure 27:
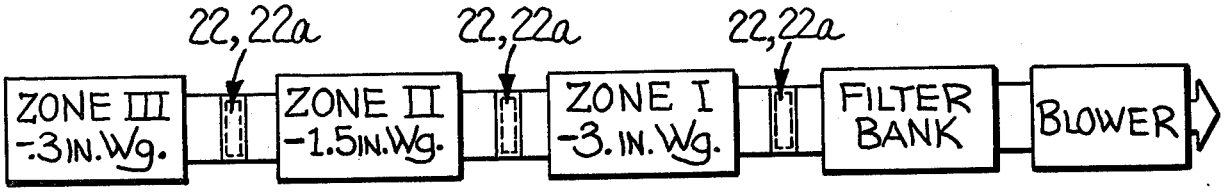
FIG. 27 illustrates a further potential use of the damper of the present invention, which involves the modulation of pressure between various zones of a building.
Figure 28:
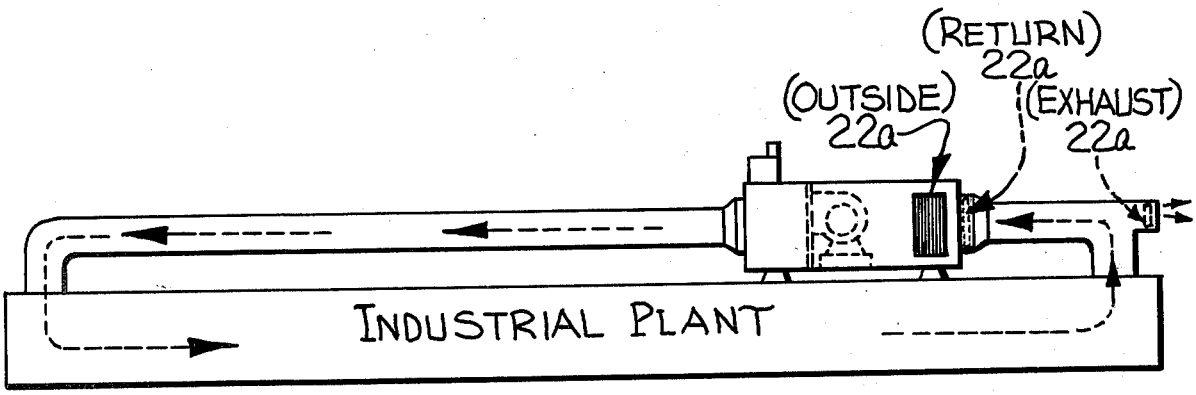
FIG. 28 is a schematic illustration of a heating or air conditioning system for an industrial plant and which is adapted to utilize dampers in accordance with the present invention.

FIGS. 26–28 schematically illustrate a number of representative air ventilation systems in which the damper of the present invention may be effectively utilized. In particular, FIG. 26 illustrates an air cleaning system of a type commonly utilized in the nuclear industry for cleaning potentially contaminated air before it is exhausted into the atmosphere. The system includes a pair of parallel air ducts 130, 131, with each duct mounting a housing 20 which contains a HEPA filter 21 and a pair of isolation dampers 22 as described above. The parallel ducts are desirable since access to the interior of each housing is periodically required for the purpose of changing the filters or damper assemblies, or maintaining or cleaning the other internal housing components. Also, a bypass system may be provided for each housing, to permit the entry of detoxifying agents or steam when the housing is used in biohazardous areas. In addition, the housing may include a nipple connection (not shown) for the purpose of conducting a pressure decay leak test of the housing in the field. As will be apparent, all of these various operations require that the housing be securely isolated from the air cleaning system, and the dampers 22 of the present invention may be utilized for this purpose.

FIG. 27 schematically illustrates a further potential use for the damper of the present invention, and which invloves the various zones of a nuclear generating plant. In such plants, it is conventional practice to zone various areas in accordance with the decree of potential hazard. For example, the interior of a hot cell which contains highly radioactive material, is usually designated as Zone I. Other areas of the plant where less high levels of radiation might be present are designated as Zone II, and general laboratory and maintenance areas are designated as Zone III. Multi-zoned buildings are ventilated so that air flow is from the less contaminated zone to the more contaminated zone, and to insure against circulation in a reverse direction, a pressure differential must be maintained between the zones. For example, minus 3 inches wg is typically required for Zone I, minus 1.5 inches wg is typically required for Zone II, and minus 0.6 inches wg is typically required for Zone III. To provide the desired pressure differentials, a damper 22 or 22*a* of the present invention may be positioned in the ventilation system between each of the zones in the manner illustrated. Each of the dampers may be automatically modulated to maintain the required pressure differential. Also, HEPA filter housings may be positioned between each zone, and at the exhaust outlet from Zone I as illustrated.

A still further representative use of dampers in accordance with the present invention may be found in an otherwise conventional heating and ventilating system for an industrial plant or other large building, and as schematically shown in FIG. 28. In the illustrated arrangement, one damper 22*a* is employed at the entrance to the outside air duct, a second damper 22*a* is positioned in the return air duct, and a third damper 22*a* is in the exhaust duct. An automatic control system is usually provided for modulating the three dampers in a known manner to provide the desired temperature and humidity conditions within the building.

In the drawings and specification, there have been set forth preferred embodiments of the invention, and although specific terms are employed, they are used in a generic and descriptive sense only and not for purposes of limitation.

That which is claimed is:

1. An air flow control apparatus for regulating the volume of air flow in a ventilating system or the like, and comprising a duct defining an air passageway therethrough, orifice frame work means extending transversely across said duct and including a plurality of troughs of V-shaped cross section disposed in a side-by-side, parallel arrangement, with each trough including side walls and a bight portion and having at least one elongate opening extending therethrough, and with each opening defining a peripheral edge portion, closure means operatively associated with each of said troughs for selectively opening and closing each of the openings therethrough, each of said closure means being sized to overlie and cover the peripheral edge portion of each such opening, with said closure means being mounted for movement between a closed position overlying and covering each opening and an open position withdrawn therefrom, and such that the opposed portions of said closure means and peripheral edge portion of each opening are relatively movable in a generally perpendicular direction toward and away from each other, and with one of said closure means and peripheral edge portion including resilient means positioned to surround the opening and be compressed to effect sealing of the opening when the closure means is in its closed position, and control means for effecting selective movement of each of said closure means between said open and closed positions, to permit full opening or full closure of the apparatus as well as modulation of the air flow rate.

2. The air flow control apparatus as defined in claim 1 wherein said closure means includes a pair of flat plates which are mounted for movement between a spread apart position contacting respective side walls of the associated trough, and a collapsed position wherein the plates are spaced from the side walls.

3. The air flow control apparatus as defined in claim 2 wherein each of said troughs includes a separate elongate opening in each side wall.

4. The apparatus as defined in claim 2 or 3 wherein said control means includes means operable from without the duct for effecting concurrent movement of each of said closure means between said open and closed positions.

5. The apparatus as defined in claim 4 wherein said pair of plates of each of said closure means are mounted for pivotal movement about an axis which extends longitudinally along the trough and adjacent the bight thereof.

6. The apparatus as defined in claim 5 wherein said resilient sealing means comprises an elastomeric sheet adhered to the surface of each of said plates.

7. The apparatus as defined in claim 2 wherein each of said plates of each pair is pivotally mounted for movement about an axis extending longitudinally along the trough and adjacent the bight thereof, and each of said closure means further comprises a hinge composed of pivotally interconnected segments, with the segments being pivotally connected to respective ones of the free edges of said pair of plates, and with the hinge pivotal axis and the pivotal axes between the segments and plates being parallel to each other and to the first mentioned pivotal axis of each plate, whereby movement of the hinge about its pivotal axis acts to either spread apart or collapse said pair of plates.

8. The apparatus as defined in claim 7 wherein said control means includes cam means mounted within said duct for engaging each of said hinges adjacent its pivotal axis to spread apart the hinges and thus each of the pair of plates, and spring biasing means for biasing each of said pair of plates toward its collapsed position.

9. The apparatus as defined in claim 7 wherein said control means includes linkage means mounted to each of said hinges adjacent its pivotal axis, and means for actuating each of said linkage means to selectively either spread apart or collapse the hinges and thus each of the pair of plates.

10. An air flow control apparatus for regulating the volume of air flow in a ventilating system or the like, and comprising a housing defining an air passageway therethrough, orifice framework means mounted within said housing and including at least one trough of generally V-shaped cross section extending transversely across said housing, with said at least one trough including two opposite sides and an intermediate bight portion, with each side having an opening which occupies a substantial portion of the area of such side, and with each of said openings having a peripheral edge portion which defines a plane, closure means operatively associated with said at least one trough for selectively opening and closing each of the openings in the associated sides thereof, said closure means including a pair of flat plates, with each of said plates being sized to overlie and cover the peripheral edge portion of one of said openings, and means pivotally interconnecting said plates and mounting said plates to said housing for pivotal movement about an axis which extends along the trough and adjacent the bight thereof and so that the plates are pivotable between a spread apart position overlying and covering the adjacent openings and a collapsed position withdrawn from said openings, and such that said plates are relatively movable toward and away from the associated sides in a generally perpendicular direction, resilient pad means surrounding the periphery of each of said openings and mounted to one of either the associated trough side or plate, and control means for effecting selective movement of said closure means between said spread apart and said collapsed positions, to permit full closing or full opening of the openings as well as modulation of the air flow rate, and such that movement of said closure means to said spread apart position causes each of said resilient pad means to be compressed between the associated trough side and plate to effect an airtight seal about the entire periphery of each opening.

11. The air flow control apparatus as defined in claim 10 wherein said resilient pad means comprises a pad of an elastomeric sheet material adhered to the surface of each of said plates.

12. The apparatus as defined in claim 10 wherein said closure means further comprises a hinge composed of pivotally interconnected segments, with the segments being pivotally connected to respective ones of the free edges of said pair of plates, and with the hinge pivotal axis and the pivotal axes between the segments and plates being parallel to each other and to the pivotal axis between said pair of plates, whereby movement of the hinge about its pivotal axis acts to either spread apart or collapse the associated pair of plates.

13. The apparatus as defined in claim 12 wherein said control means includes linkage means mounted to said hinge adjacent its pivotal axis, and means for actuating said linkage means to selectively either spread apart or collapse the hinge and the associated pair of plates.

14. The air flow control apparatus as defined in claim 13 wherein said means for actuating said linkage means comprises a shaft rotatably mounted to extend across the interior of said housing in a direction parallel to the transverse direction of the associated trough, with at least one end of said shaft extending through the housing so as to be accessible from the exterior thereof, and wherein said linkage means comprises a linkage operatively interconnecting said shaft and said hinge and so that rotation of said shaft effects movement of said hinge about its pivotal axis.

* * * * *